US006623257B2

(12) United States Patent
Taniguchi

(10) Patent No.: US 6,623,257 B2
(45) Date of Patent: Sep. 23, 2003

(54) DISPOSABLE MECHANISM FOR TAKING OUT A FIXED AMOUNT OF FLUID AND SYSTEM FOR SUPPLYING A FIXED AMOUNT OF FLUID

(75) Inventor: Fumio Taniguchi, Tokyo (JP)

(73) Assignee: Libra Techno Yugen Kaisha, Tokyo (JP)

( * ) Notice: Subject to any disclaimer, the term of this patent is extended or adjusted under 35 U.S.C. 154(b) by 0 days.

(21) Appl. No.: 09/899,468

(22) Filed: Jul. 5, 2001

(65) Prior Publication Data

US 2002/0039537 A1 Apr. 4, 2002

(30) Foreign Application Priority Data

Apr. 10, 2000 (JP) ..... 2000-341143
Apr. 5, 2001 (JP) ..... 2001-107032

(51) Int. Cl.[7] ..... F04B 45/06
(52) U.S. Cl. ..... 417/478; 222/1; 222/137; 222/212
(58) Field of Search ..... 417/472, 478, 417/567; 222/105, 107, 207, 212, 214, 215, 383.1, 333

(56) References Cited

U.S. PATENT DOCUMENTS 4,060,178 A * 11/1977 Miller ..... 192/48.2
5,033,647 A * 7/1991 Smith et al. ..... 222/212
5,242,081 A * 9/1993 van der Heyden et al. ..... 222/1
5,409,144 A * 4/1995 Brown ..... 220/203.17
2001/0025860 A1 * 10/2001 Auer ..... 222/137

* cited by examiner

*Primary Examiner*—Charles G. Freay
*Assistant Examiner*—Emmanuel Sayoc
(74) *Attorney, Agent, or Firm*—Lackenbach Siegel LLP

(57) ABSTRACT

There is provided a system for supplying a fixed amount of fluid in which the reverse flow of the fluid is eliminated and a precise fixed amount of the fluid can be delivered. In a system for supplying a fixed amount of fluid comprising a fluid accommodating unit comprising a fluid accommodating bag and a pump connected to the fluid accommodating bag and a fluid supplying device body in which the fluid accommodating unit is detachably disposed and a pump driving mechanism for driving the pump is disposed, the pump of the fluid accommodating unit is a bellows pump having two check valves; the check valve comprises a valve base having through-holes formed therein and whose downstream surface is curved to be convex toward the downstream and a valve body made from an elastic thin plate for covering the downstream surface of the valve base and having a hole at the center thereof; and the pump driving mechanism drives a bellows so as to expand and contract it at a predetermined stroke.

12 Claims, 8 Drawing Sheets

【Fig 1】
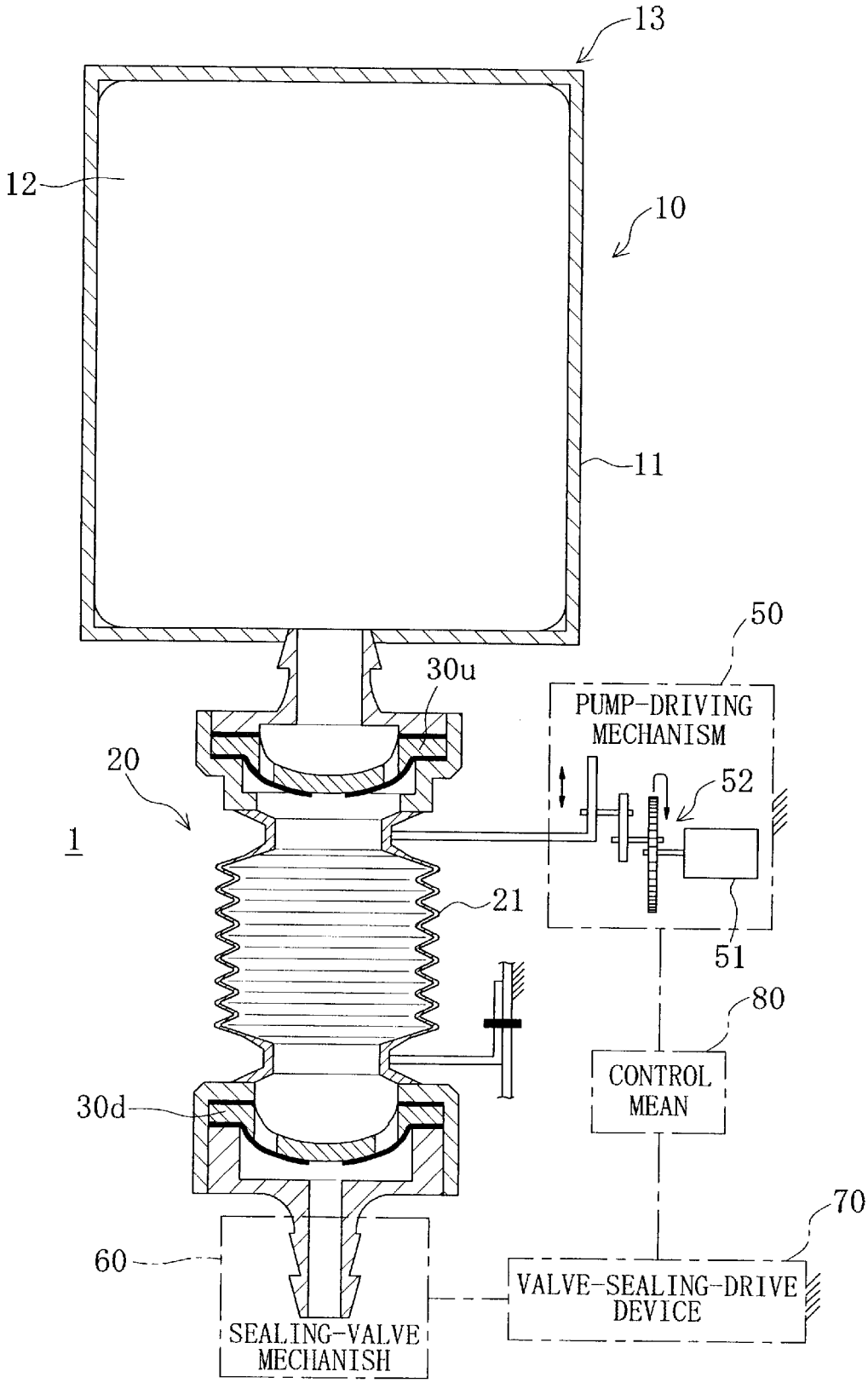

【Fig 2】
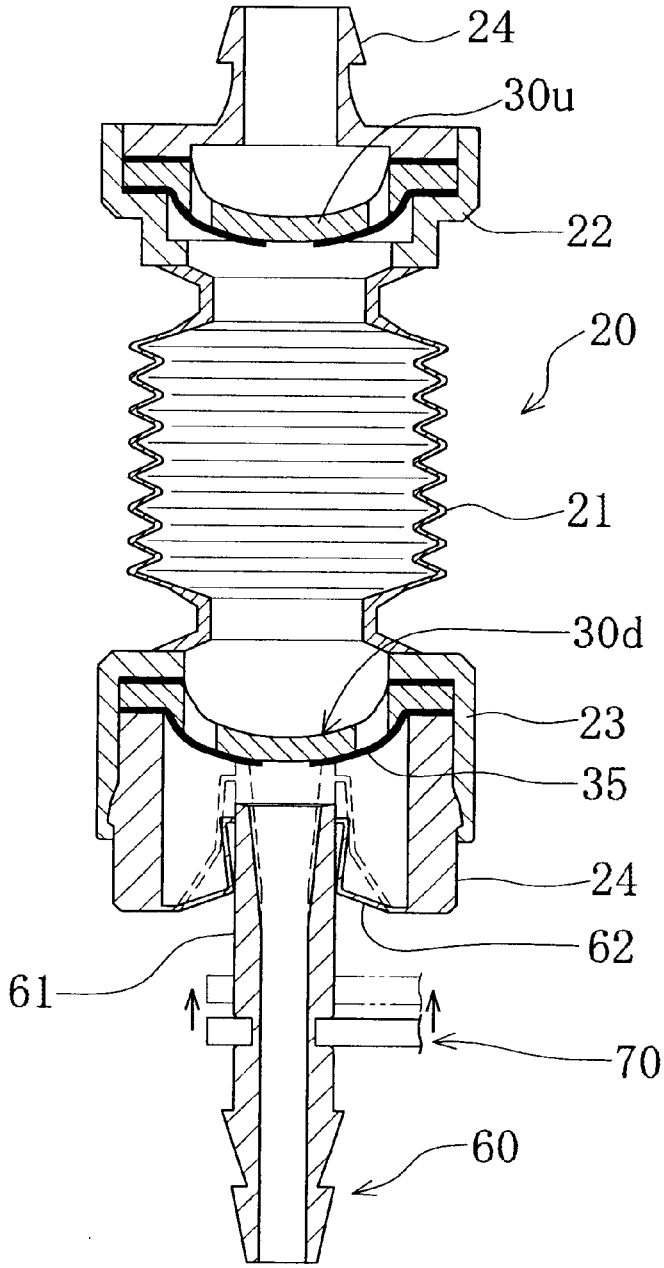

【Fig 3】
(A)
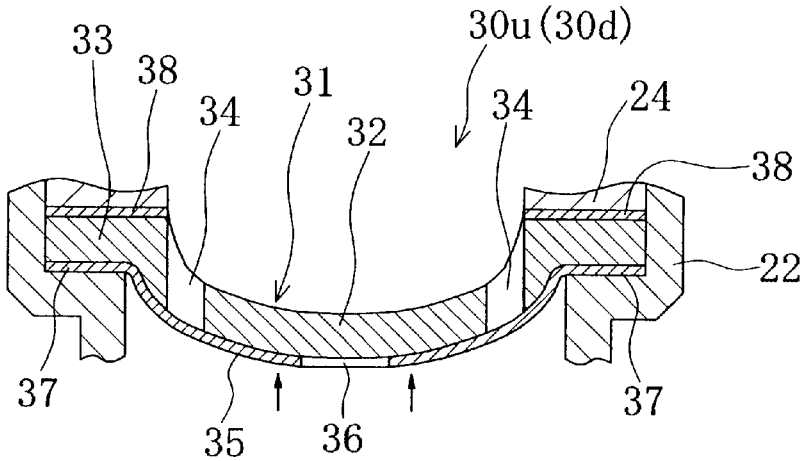
(B)
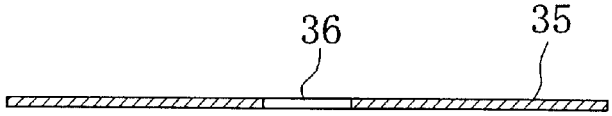
【Fig 4】
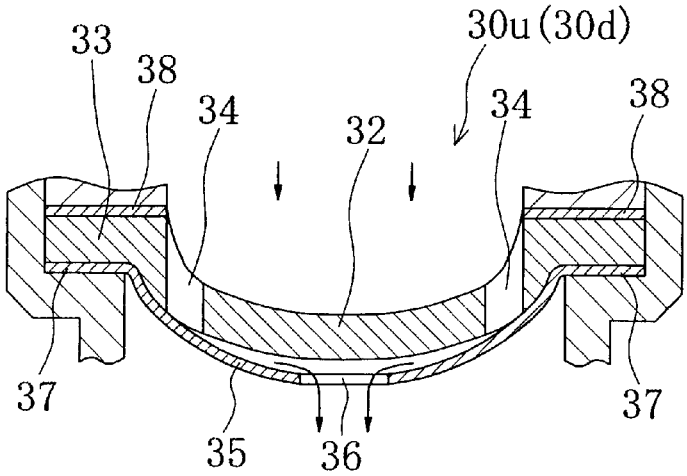

【Fig 5】
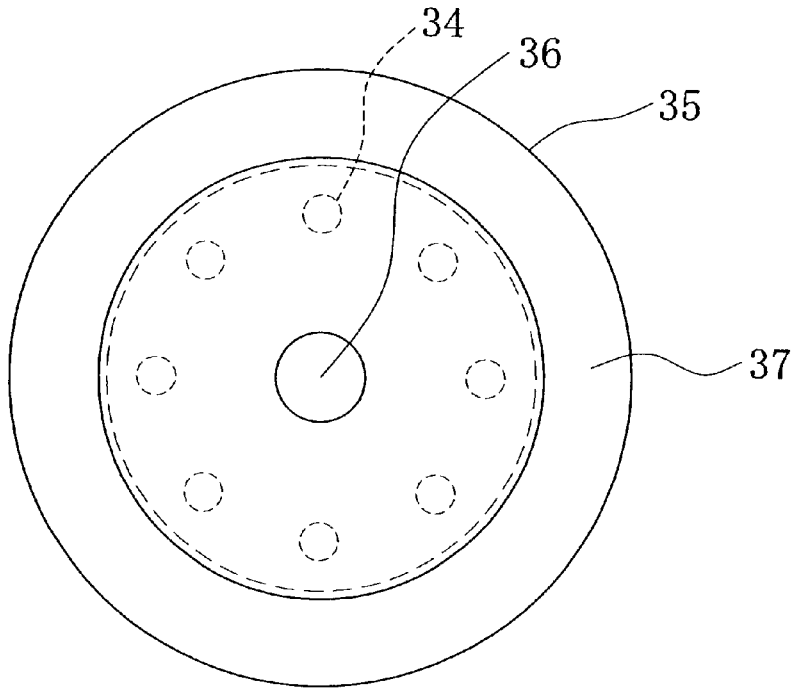

【Fig 6】
(A)
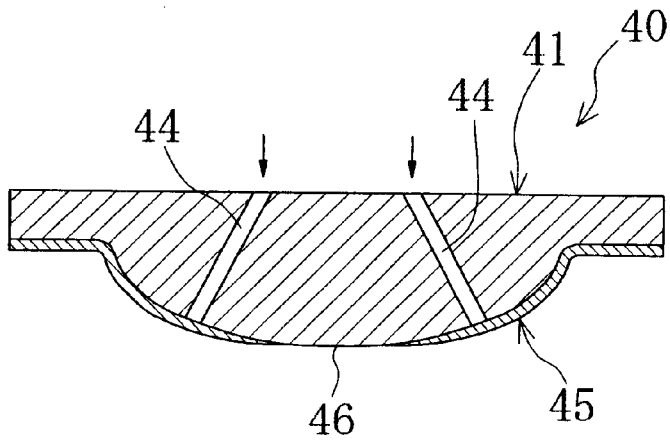
(B)
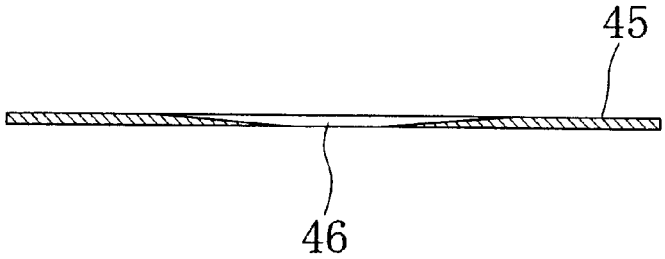
【Fig 7】
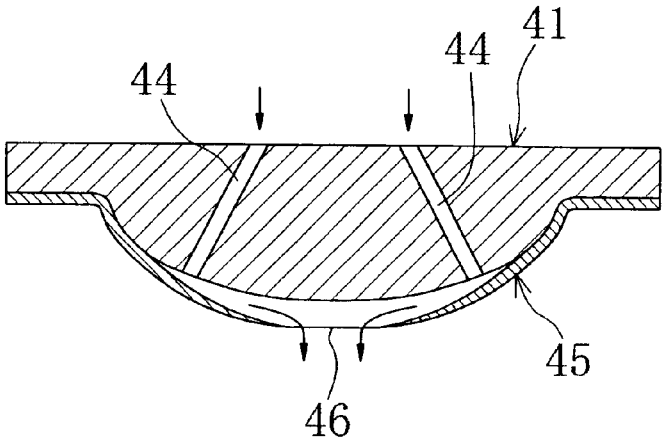

【Fig 8】
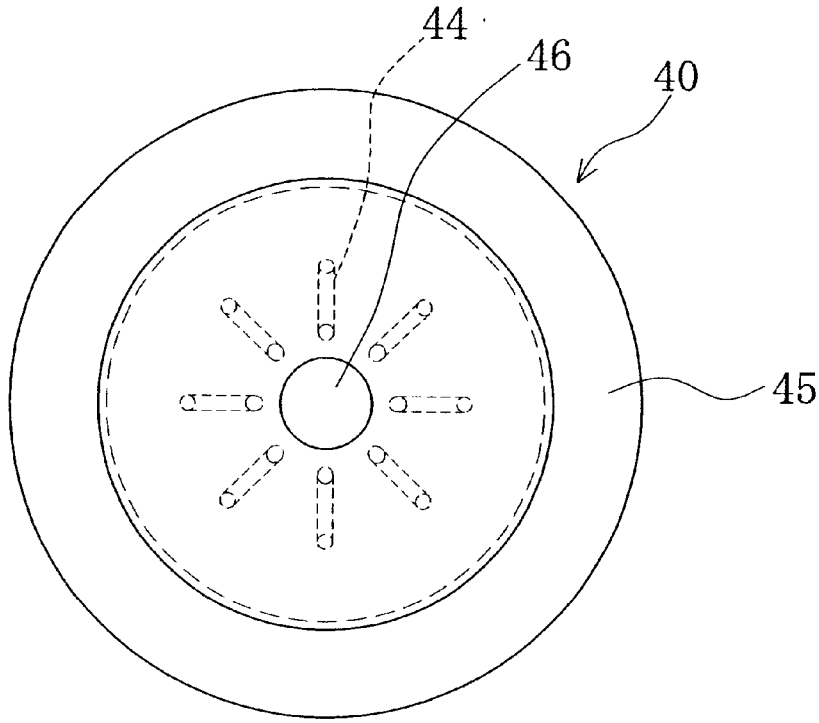

【Fig 9】
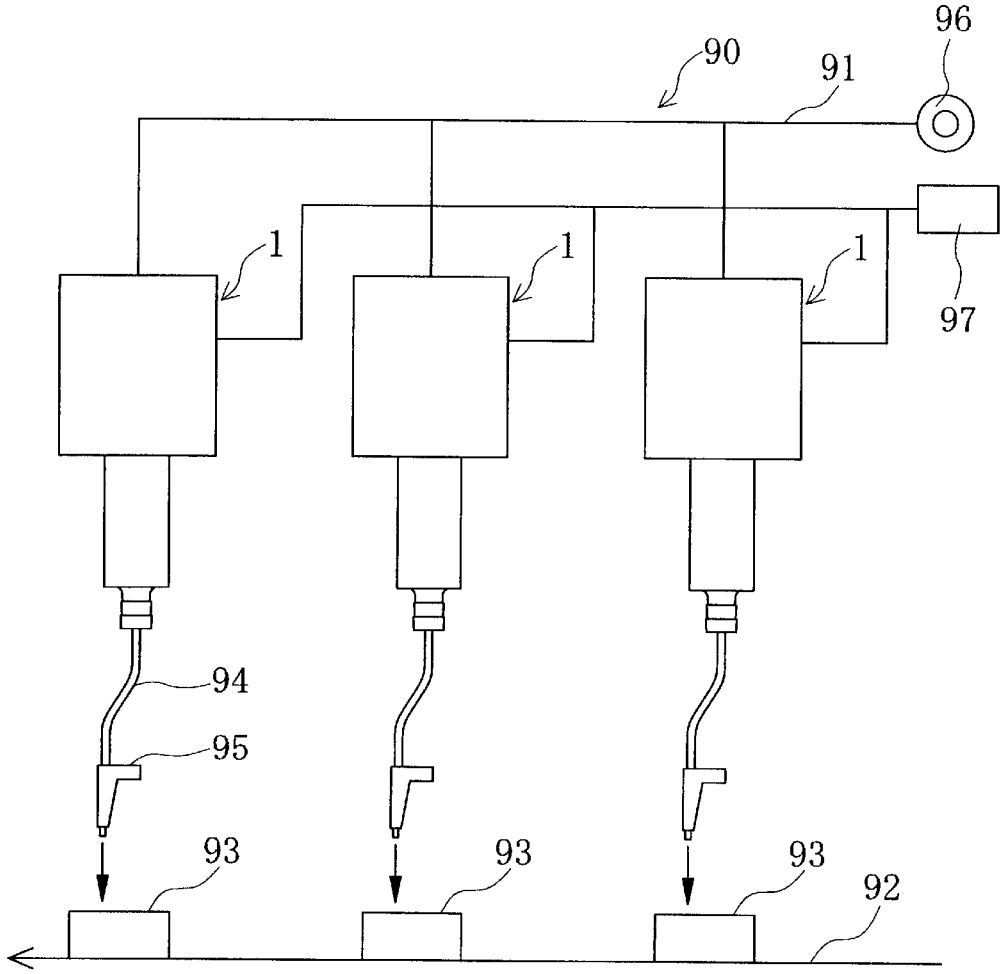

【Fig 1 0】
(A)
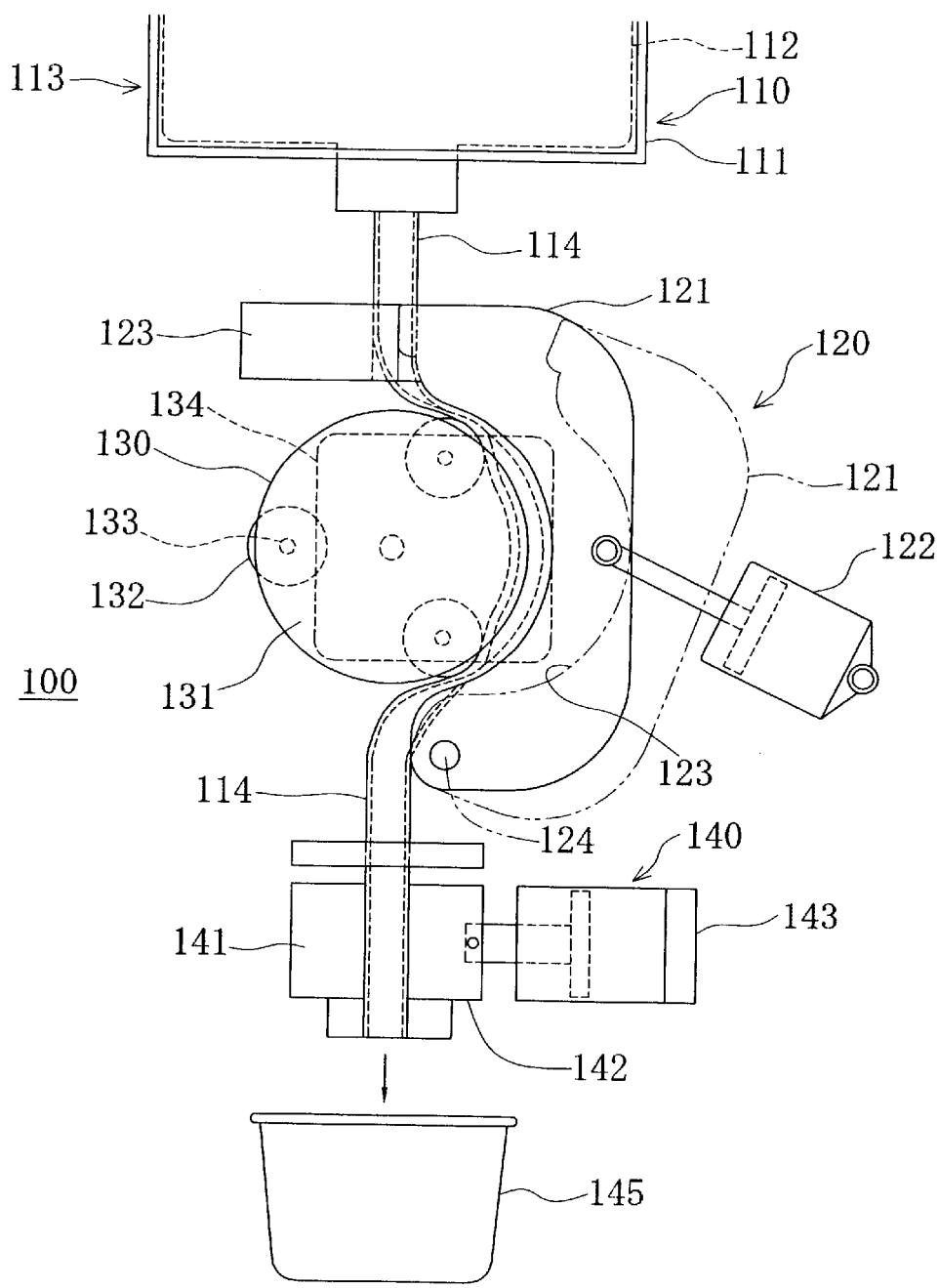
(B)
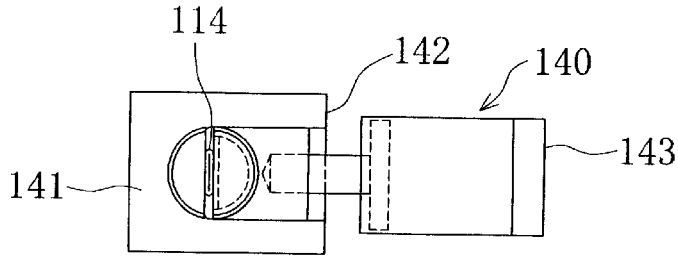

DISPOSABLE MECHANISM FOR TAKING OUT A FIXED AMOUNT OF FLUID AND SYSTEM FOR SUPPLYING A FIXED AMOUNT OF FLUID

BACKGROUND OF THE INVENTION

1. Field of the Invention

The present invention relates to a system for supplying a fixed amount of fluid, and in particular relates to a system which comprises a fluid accommodating unit formed of a fluid accommodating bag for accommodating fluid and a pump for delivering the fluid from the fluid accommodating bag and a fluid supplying device body in which the fluid accommodating unit is detachably placed and a pump driving mechanism for driving the pump is provided, wherein when supplying the fluid, a fixed amount of fluid is supplied by placing the fluid accommodating unit in the fluid supplying device body.

2. Description of the Related Art

As a system for supplying a fixed amount of fluid, there has been a post-mix-type beverage supplying system. In such a beverage supplying system, a fluid accommodating unit is detachably placed in a fluid supplying device body and has a bag in box (BIB) therein which accommodates condensed syrup such as that of coffee or tea. When supplying beverage, a fixed amount of the syrup is delivered to a cup, etc., with a pump so as to supply the beverage by mixing the syrup with water, carbonated water, or boiling water.

In such a system, a predetermined fixed amount of the syrup always requires being delivered every time of the beverage supply. Since the syrup once delivered may be contaminated by various germs when it flows into the pump or the BIB, the reverse flow of the syrup has to be securely prevented.

As one of such systems, there is provided a system using a tube pump shown in FIGS. 10A and 10B (see Japanese Unexamined Patent Application Publication No. 04-42271). In the system, a fluid accommodating unit 110 for enclosing syrup therein, which is placed in a supplying device 100, comprises a BIB 113, in which a bag 112 made from flexible film is placed in a box 111, and a tube 114 made from an elastic material such as silicone rubber and attached to the BIB 113 so as to hang therefrom.

The supplying device 100 is provided with a pump unit 120 disposed at a position where the tube 114 hangs, which forms the tube pump in cooperation with the tube 114. At a position lower than the pump unit 120 in the supplying device 100, a tube-pinching device 140 is provided for sealing up the end of the tube 114 when the syrup is not delivered. In addition, a container 145 shown in FIG. 10A is a paperboard cup, etc., for receiving beverage therein.

The pump unit 120 comprises a tube-guide member 121 with a circular tube-guide path 123 formed on one face thereof and a driving cylinder 122 for rotating the tube-guide member 121 about a rotating axis 124. The tube-guide member 121 is driven by the driving cylinder 122 so as to be switched between a pump-driving position (shown by a solid line in FIG. 10A) at which the pump fixed by a locking member of the tube-guide member 121 can be driven and a tube-inserting position (shown by a phantom line in FIG. 10A) used when the tube is inserted.

The pump unit 120 also comprises a rotating roller 130 for pinching the tube 114 against the tube-guide member 121 so as to squeeze the syrup in the tube 114 therefrom. The rotating roller 130 comprises a disc-like rotating base plate 131 driven by a driving motor 134 and rollers 132 rotatably fixed to a plurality (three in this example) of pins 133 spaced around the circumference of the rotating base plate 131 at equal intervals. The rotating roller 130 is driven by a predetermined rotating angle in accordance with the amount of the syrup required to be delivered.

When the fluid accommodating unit 110 is attached thereto, the tube-guide member 121 is switched to the tube-inserting position so that the tube 114 is arranged between the tube-guide member 121 and the rotating roller 130 and then, the tube-guide member 121 is switched to the pump-driving position.

The tube-pinching device 140 comprises a fixing member 141 fixed to the supplying device 100, a pinching member 142 for pinching an end portion of the tube 114 against the fixing member 141 so as to seal the tube 114 off, and a cylinder member 143 for pushing and retracting the pinching member 142. Therefore, various germs and the like cannot enter thereinto via the tube 114.

However, in a system for supplying a fixed amount of fluid using such a tube pump, when exchanging a BIB, troublesome processes have to be stepped, in which the tube-guide member 121 is switched to the tube-inserting position, the tube 114 is arranged between the tube-guide member 121 and the rotating roller 130 by curving the tube 114, and the tube-guide member 121 is then switched to the pump-driving position.

Although the end of the tube is sealed off by the pinching device in a state that the fluid accommodating unit 110 is placed in the supplying device, there may be a problem in which during exchanging the BIB, the syrup accommodated in the BIB is discharged from the tube or air enters into the BIB so that various germs are mixed with the syrup in the BIB, because any special closing means is not provided in the tube itself.

Accordingly, instead of the tube pump of a conventional system for supplying a fixed amount of fluid, the use of a bellows pump is expected. The bellows pump comprises a bellows having an internal volume being variable by the external drive and two check valves respectively arranged in the flow-inlet and the flow-outlet of the bellows.

The check valve for use in a conventional bellows pump generally has a structure in which a fluid path formed on a valve base is opened and closed by a planer or spherical valve body.

That is, in the check valve using the planer valve body: one end of the planer valve body is attached to the valve base; the opening of the fluid path is normally closed due to the elasticity of the valve body; when fluid flows toward the delivery, the valve body is separated from the opening of the fluid path due to the pressure of the fluid so that the opening of the fluid path is opened.

In the check valve using the spherical valve body: the valve body is pushed to the opening of the fluid path from the downstream by an elastic member such as a coil spring so that the opening of the fluid path is normally closed; when fluid flows toward the delivery, the valve body is separated from the opening of the fluid path by compressing the coil spring, etc., due to the pressure of the fluid so that the opening of the fluid path is opened.

However, in the above-mentioned check valves, although the reverse flow of the fluid can be prevented during driving of the pump, the check valve may be opened due to the external impulse so that there have been problems that the leakage is produced from the check valve during the fluid delivery so that the syrup may be delivered in excess of a predetermined amount or the syrup once delivered flows backward into the pump so that the syrup in the pump and the BIB may be contaminated with various germs.

SUMMARY OF THE INVENTION

In view of the above-described situations, the present invention has been made, so that it is an object of the present invention to provide a disposable mechanism for taking out a fixed amount of fluid and a system for supplying a fixed amount of fluid in which the reverse flow of the fluid is eliminated and a precise fixed amount of the fluid can be delivered.

According to the present invention, the above-mentioned object can be achieved by a disposable mechanism for taking out a fixed amount of Fluid and a system for supplying a fixed amount of fluid which will be described.

In accordance with a first aspect of the present invention, a disposable mechanism for taking out a fixed amount of fluid by bellows pump with check valves comprising a bellows pump, two check valves attached to both ends of the bellows pump, a bag made from flexible film positioned at the check valve of fluid-flow-inlet side and the previously-mentioned check valve is comprised of; hemisphere shaped valve base, hemisphere shaped valve of elastic material such as rubber which the periphery being attached to the hemisphere shaped valve base and are shaped to cover closely the round surface of the hemisphere shaped valve base and has round holes located near the center of it, and fluid piercing hole placed in piercing condition in the center of the valve base from the flat surface to the round surface.

In accordance with a second aspect of the present invention, a disposable mechanism for taking out a fixed amount of fluid by bellows pump with check valves, described in claim 1, characterized by fluid piercing holes placed several on circumference of check valve, and each fluid piercing hole is either placed in radial direction from the flat surface of the hemisphere shaped valve base to the round surface or in vertical direction from the flat surface of the valve base.

In accordance with a third aspect of the present invention, a system for supplying a fixed amount of fluid comprises a fluid accommodating unit comprising a fluid accommodating bag for accommodating fluid therein and a pump connected to the fluid accommodating bag for pumping the fluid, and a fluid supplying device body in which the fluid accommodating unit is detachably disposed and in which a pump driving mechanism for driving the pump is disposed, the system supplying a fixed amount of the fluid by the fluid accommodating unit in the fluid supplying device body when the fluid is being supplied, wherein the pump of the fluid accommodating unit is a bellows pump comprising a bellows and two check valves arranged in a fluid inlet and a fluid outlet of the bellows, respectively, the check valve comprising a valve base whose downstream surface is curved to be convex toward the downstream side and a valve body made from an elastic thin plate for covering the downstream surface of the valve base, the valve base having fluid-flow-through holes extending from the fluid upstream surface to portions of the downstream surface covered with the valve body, the valve body being fixed to the valve base on the periphery of the valve body while having a hole at the center thereof for allowing the flow of the fluid, and wherein the pump driving mechanism of the fluid supplying device body drives the bellows so as to expand and contract the bellows at a predetermined stroke when the fluid accommodating unit is placed in the system for supplying a fixed amount of fluid.

In accordance with a fourth aspect of the present invention, a system for supplying a fixed amount of fluid comprises a fluid accommodating unit comprising a fluid accommodating bag for accommodating fluid therein and a pump connected to the fluid accommodating bag for pumping the fluid, and a fluid supplying device body in which the fluid accommodating unit is detachably disposed and in which a pump driving mechanism for driving the pump is disposed, the system supplying a fixed amount of the fluid by the fluid accommodating unit in the fluid supplying device body when the fluid is being supplied, wherein the pump of the fluid accommodating unit is a bellows pump comprising a bellows and two check valves arranged in a fluid inlet and a fluid outlet of the bellows, respectively, the check valve comprising a valve base whose downstream surface is curved to be convex toward the downstream side and a valve body made from an elastic thin plate for covering the downstream surface of the valve base, the valve base having fluid-flow-through holes extending from the fluid upstream surface to portions of the downstream surface covered with the valve body, the valve body being fixed to the valve base on the periphery of the valve body while having a hole at the center thereof for allowing the flow of the fluid, the pump driving mechanism of the fluid supplying device body driving the bellows so as to expand and contract the bellows at a predetermined stroke when the fluid accommodating unit is placed in the system for supplying a fixed amount of fluid, and wherein an outlet of the fluid accommodating unit is provided with closing means for closing the outlet and the fluid supplying device body is provided with a sealing-valve driving device for driving the closing means when the bellows pump is not being driven.

According to the third and the fourth aspect of the present invention, because in the check valve of the bellows pump, the downstream surface of the valve base is curved to be convex toward the downstream side and the fluid-flow-through holes are formed so as to extend from the fluid upstream surface of the valve base to portions of the downstream surface covered with the valve body, and the valve body made from an elastic thin plate for covering the downstream surface of the valve base is fixed to the valve base on the periphery of the valve body while having a hole at the center thereof for allowing the flow of the fluid, when pressure is not applied to the valve body from the upstream or pressure is applied to the valve body from the downstream, the valve body adhere closely to the downstream surface of the valve base so as to plug the fluid-flow-through holes.

Accordingly, fluid is not allowed to flow toward the upstream in these states. Only when pressure is applied to the fluid from the upstream, the valve body is pushed toward the downstream so as to form a clearance between the valve body and the valve base, so that the fluid flows from the fluid-flow-through holes of the valve base toward the downstream via the hole for allowing the flow of the fluid of the valve body.

Because the pump driving mechanism of the fluid supplying device body drives the bellows so as to expand and contract the bellows at a predetermined stroke when the fluid accommodating unit is placed in the system for supplying a fixed amount of fluid, a fixed amount of the fluid is securely pumped by driving the bellows pump.

Furthermore, according to the fourth aspect, an outlet of the fluid accommodating unit is provided with closing means for closing the outlet and the fluid supplying device body is provided with a sealing-valve driving device for driving the closing means when the bellows pump is not being driven, thereby the reverse flow of the fluid from the outlet of the fluid accommodating unit is securely prevented.

In a system for supplying a fixed amount of fluid according to the third and the fourth aspect of the present invention, an end of the fluid accommodating unit is preferably provided with replacement-part-fitting means which can attach an attached replacement part to the fluid accommodating unit.

The end of the fluid accommodating unit may be provided with the replacement-part-fitting means, so that an attached replacement part having a required function may be attachable and detachable thereto freely. As the attached replacement part, a reverse-flow-preventing device of fluid and a mixing device with other kinds of fluid may be adopted.

Preferably, the attached replacement part is a mixing device for mixing a fixed amount of the fluid supplied with another kind of fluid. As the other kinds of fluid, there are cold water, carbonated water, warm water, and so forth, and the most suitable mixing device for the kind of the fluid may be selected therefrom for attaching thereto.

Thereby, when a supplying system for one kind of beverage is changed to that for another different kind of beverage, the entire fluid supplying system is not necessarily required to change only when the attached replacement part is replaced.

Preferably, the valve body is a thin film having a predetermined thickness. The valve body is thereby manufactured easily by punching the thin film with a predetermined thickness so as to have a predetermined shape.

Preferably, the valve body is a thin film in which the thickness decreases toward the hole formed at the center.

Because the valve body is a thin film with the thickness decreasing toward a hole formed at the center thereof, so that it is elastically deformed by a small force, a small pressure difference between the upstream and the downstream of the valve causes the valve body to stick to or separate from the valve base, resulting in the achievement of the secure opening and closing operations of the valve.

Preferably, the pump driving mechanism is a reciprocating mechanism for vertically reciprocating at least one of upper and lower ends of the bellows.

In this case, at least one of upper and lower ends of the bellows is vertically reciprocated by the pump driving mechanism so that fluid can be fed under pressure in a one-way direction by the operation of the two check valves respectively arranged in the fluid-flow-inlet in the upstream of the bellows and the fluid-flow-outlet in the downstream of the bellows. It is sufficient for the vertical reciprocating only to change the internal volume of the bellows, so that one or both of the upper and lower ends may be vertically moved.

Preferably, the pump driving mechanism is provided with control means for controlling the number of cycles of the reciprocating driving and the reciprocating speed during one time supplying operation.

The number of cycles of the reciprocating driving and the reciprocating speed of the bellows during one time supplying operation are thereby controlled by the control means in the pump driving mechanism, so that the fluid may be pumped at a amount and speed optimum for the kind and viscosity, etc. of the fluid.

Preferably, the fluid accommodating unit is provided with a sealing-valve mechanism as closing means and the fluid supplying device body is provided with a driving mechanism for driving the sealing-valve mechanism.

When the fluid accommodating unit is provided with the sealing-valve mechanism which is driven by the driving mechanism for driving the sealing-valve mechanism disposed in the fluid supplying device body, the sealing-valve mechanism contacting the fluid can be replaced together with the fluid accommodating unit during the replacement of the fluid accommodating unit, thereby not only saving a time and energy for the replacement but also the leakage of the fluid out of the unit during the replacement can be prevented so as to eliminate labor for cleaning the fluid accommodating unit.

Preferably, the sealing-valve mechanism of the fluid accommodating unit is formed as a cylinder which vertically moves so that the periphery of the valve body hole of the lower check valve can be pushed against the valve base while allowing the fluid to flow-through the inside of the cylinder.

In this case, because the sealing-valve mechanism of the fluid accommodating unit is formed as the cylinder which vertically moves so that the periphery of the valve body hole of the lower check valve can be pushed against the valve base while allowing the fluid to flow-through the inside of the cylinder, the number of parts of the sealing-valve mechanism can be reduced, resulting in reduction of the manufacturing cost.

BRIEF DESCRIPTION OF THE DRAWINGS

FIG. 1 is a partly sectional front view of a system for supplying a fixed amount of fluid according to the present invention;

FIG. 2 is an enlarged sectional view of a bellows pump used in the system for supplying a fixed amount of fluid shown in FIG. 1;

FIGS. 3A and 3B show a check valve used in the system for supplying a fixed amount of fluid shown in FIG. 1, FIG. 3A is an enlarged sectional view of the check valve in a closed state, and FIG. 3B is an enlarged sectional view of a valve body of the check valve;

FIG. 4 is an enlarged sectional view of the check valve in an opened state used in the bellows pump shown in FIG. 2;

FIG. 5 is a bottom plan view of the check valve shown in FIG. 3;

FIGS. 6A and 6B show another check valve used in the bellows pump shown in FIG. 2, FIG. 6A is an enlarged sectional view of the check valve in a closed state, and FIG. 6B is an enlarged sectional view of a valve body of the check valve;

FIG. 7 is an enlarged sectional view of the other check valve in an opened state used in the bellows pump shown in FIG. 2;

FIG. 8 is a bottom plan view of the check valve shown in FIG. 7;

FIG. 9 is a schematic diagram of a fluid supplying system having plural fluid supplying devices according to the present invention; and FIGS. 10A and 10B show a conventional system for supplying a fixed amount of fluid, FIG. 10A is a front view thereof, and FIG. 10B a bottom plan view showing a tube-pinching device when a fluid supplying pipe is closed.

DESCRIPTION OF THE PREFERRED EMBODIMENTS

An embodiment of the present invention will be described below with reference to the attached drawings. The embodiment is a supplying system of post-mix type beverage just like the conventional system described above. In the embodiment, beverage is one time supplied by diluting 5 ml of syrup 20 to 30 times with cold water, carbonated water, hot water, or the like.

In a beverage supplying system according to the embodiment, a fluid accommodating unit 10 disposed in a supplying apparatus 1 for accommodating syrup sealed up therein comprises a BIB 13 comprising a box 11 and a bag 12 made from flexible film and arranged in the box 11 and a bellows pump 20 made from a synthetic resin such as polyethylene and attached to the BIB 13 so as to hang therefrom. The lower end of the bellows pump 20 is provided with a valve-sealing mechanism 60 for sealing up the lower end of the bellows pump 20 when the syrup is not delivered.

The supplying apparatus 1 is provided with a pump-driving mechanism 50 for driving the bellows pump 20 and a valve-sealing-drive device 70 for driving the valve-sealing mechanism 60.

The bellows pump 20, as shown in FIG. 2, comprises a bellows 21 and two check valves 30*u* and 30*d* respectively arranged in the fluid-flow-inlet in the upstream of the bellows and the fluid-flow-outlet in the downstream of the bellows. The bellows 21 is a bellows member formed by blow-molding a soft synthetic resin such as polyethylene or polystyrene, in which the internal volume is changeable by changing the longitudinal size thereof in the vertical direction. To the bellows 21, the check valves 30*u* and 30*d*, the BIB 13, and cylindrical parts 22 and 23 for fixing the valve-sealing mechanism 60, which is sealing means, to the bellows 21 are attached up and down.

In the embodiment, the two check valves 30*u* and 30*d* have the same shape and allow the movement of the syrup as fluid only in the direction from the BIB 13 (upstream) to the lower part (downstream). When the upper check valve 30*u* is described as it is identical in the structure with the lower check valve 30*d*, the check valve 30*u*, as shown in FIGS. 3A to 5, has the downstream surface curved to be convex to the downstream while comprises a disc-like valve base 31 having a recess in the upstream and a valve body 35 formed of an elastic thin plate and covering the downstream surface of the valve base 31.

Also, in the embodiment, the valve base 31 has eight holes 34 penetrated from the fluid upstream surface to the covered portions with the valve body 35 of the downstream surface in parallel with the axis of the bellows pump 20 for allowing to flow-through fluid while it is provided with a fitting flange 33 formed in the periphery thereof.

The valve body 35, as shown in FIGS. 3A to 4, is fixed to the valve base 31 so that the periphery 37 thereof is putted into the cylindrical part 22 while having a hole 36 at the center thereof for allowing to flow-through the fluid. In the embodiment, the valve body 35 is formed from an elastic material such as silicone rubber to have a circular disc shape which has a thin thickness of approximately constant 0.5 mm and the hole 36 formed at the center, as shown in FIG. 3B. In the embodiment, the valve body 35, as shown in FIG. 3A, adheres closely to the valve base 31 by holding the disc-like valve body 35 with the cylindrical part 22 so as to be attached to the valve base 31. Therefore, the valve body 35 according to the embodiment can be easily manufactured only by punching a planar plate to have a predetermined shape without another processing.

In these check valves 30*u* and 30*d*, when the fluid pressure in the upstream (upper part in FIG. 3A) is larger than that in the downstream (lower part in FIG. 3A), that is, for the check valve 30*u* when the bellows pump 20 is compressed and for the check valve 30*d* when the bellows pump 20 is extended, the valve body 35 is urged to the valve base 31 so as to close the openings of the holes 34 of the valve base 31, thereby stopping the flowing of the fluid (FIG. 3A).

On the other hand, when the fluid pressure in the downstream is larger than that in the upstream, that is, for the check valve 30*u* when the bellows pump 20 is extended and for the check valve 30*d* when the bellows pump 20 is compressed, the valve body 35 is separated from the valve base 31, thereby flowing the fluid through the holes for allowing to flow-through the fluid (FIG. 4).

The pump-driving mechanism 50 of the fluid supplying device body drives the bellows 21 so as to expand and contract it at a predetermined stroke in a state of the fluid accommodating unit 10 being placed in the system for supplying a fixed amount of fluid. For example, as shown in FIG. 1, a unit of an electric motor 51 combined with a link mechanism 52 for converting rotational motion into linear motion can be used. Another mechanical mechanism such as an electrically-driven actuator using gears, a solenoid, and a pneumatic or oil-hydraulic rectilinear-motion mechanism may be used as the pump-driving mechanism 50 by selecting therefrom.

The pump-driving mechanism 50 is provided with control means 80 for controlling the number of reciprocating drives and a reciprocating speed during one time supplying operation. The control means 80 controls the pump-driving mechanism 50 so as to have a delivery amount and a delivery speed optimum for the kind and viscosity, etc., of the fluid. As the control means 80, a sequential controller, a microcomputer, and so forth may be used.

In the embodiment, the outlet of the fluid accommodating unit 10 is provided with a sealing-valve mechanism 60 as closing means for closing the outlet. The sealing-valve mechanism 60, as shown in FIG. 2, comprises a cylindrical part 61, which is vertically moved so that the hole fringe of the valve body 35 of the lower check valve 30*d* can be urged to the valve base 31 while it can flow the fluid through the inside thereof, and a thin-plate-closing flange 62 which covers the periphery of a cylindrical part 24, which is attached to the downstream side of the lower check valve 30*d*, from the periphery of the cylindrical part 61, and is driven by the valve-sealing-drive device 70. As the valve-sealing-drive device 70 in the embodiment, a driving mechanism having the same structure as that of the pump-driving mechanism 50 such as an electrically-driven mechanism can be used, which controls the operational timing and the operational quantity by connecting the control means 80 thereto.

Next, another example of a check valve according to the present invention will be described. Differences of a check valve 40 according to the example from the above-mentioned check valves 30*u* and 30*d* are, as shown in FIGS. 6A to 7: a valve body 45 is a thin film with the thickness decreasing toward a hole 46 formed at the center of the valve body 45; a valve base 41 has a large thickness without a recess in the upstream side; and a fluid path 44 is formed along the axial line of the bellows pump so as to be opened toward the downstream.

Although the fundamental function of the check valve 40 of this example is the same as that of the above-described check valves 30*u* and 30*d*, because the valve body 45 is a thin film with the thickness decreasing toward a hole formed at the center thereof so that it is elastically deformed by a small force, a small pressure difference between the upstream and the downstream of the valve causes the valve body to stick to or separate from the valve base, resulting in the achievement of the secure opening and closing operations of the valve. Also, the valve base 41 can be processed easily by the absence of a recess in the upstream.

In the system for supplying a fixed amount of fluid according to the present invention, the following embodiments can be made other than the above-described embodiment. That is, the above-mentioned sealing-valve mechanism can be detachably placed as an attached replacement part via an attachment joint being attachable and detachable to the end of the bellows pump.

As an attached replacement part, there is a mixing device for mixing another fluid with syrup. The fluid such as cold water, carbonated water, hot water, or the combination of these kinds of fluid can be mixed with the syrup. An aerial-mix-type of fluid mixing device can be used, in which a nozzle for each fluid to be mixed is independently arranged so as to inject the fluid for mixing, may be used while the mixing may also be performed within a container. Furthermore, a device having a mechanical mixing mechanism using a rotary impeller may also be used.

Appliances related to the fluid supply such as an extension hose, a spraying device, an atomizer, and a fluid-injection gun being operative linked to the pump-driving mechanism may be adopted as replacement parts.

Moreover, in the above-described embodiments, the syrup for beverage is described as an example of the fluid to be delivered by a fixed amount; the fluid in the present invention is not limited to the syrup. That is, the fluid such as water, warm water, soft drinks to be supplied without dilution such as juice, alcoholic liquors, seasonings to be supplied by a fixed amount such as ketchup, mayonnaise, mustard, sauce, and soup for noodles may be applied to the present invention.

When a system for supplying a fixed amount of fluid according to the present invention is used for food in such a manner, the food contamination due to the reverse flow of the food can be prevented together with the precise and secure supply of a fixed amount of food.

The fluid applied to the present invention is not limited to the food; other kinds of fluid such as irrigation water for vegetation, liquid fertilizer, agricultural chemicals, oil such as lubricating oil and grease, adhesive, and glue may be used. When the system is used especially for oil and adhesive which take time for cleaning, because of the disposability of the pump and the fluid container, washing and cleaning of the pump and the fluid supplying device do not take time.

When embodying the present invention, as shown in FIG. 9, plural fluid supplying devices 1 according to the present invention may be arranged so as to form a fluid supplying system 90. In the fluid supplying system 90, while an object 93 to be filled with fluid is conveyed by a conveying line 92, the object 93 can be sequentially filled with the fluid to be supplied by injectors 95. During the filling, while motive power such as electric power, pneumatic pressure, and oil-hydraulic pressure is supplied in common to each supplying device 1 from a power source 96 via a supplying line 91, each supplying device 1 can be automatically operated by providing a principal controller 97 which can drive each supplying device 1 in accordance with the arrival timing of the object 93 conveyed.

In such a manner, the field applicable to a system for supplying a fixed amount of fluid according to the present invention may be any one as long as it supplies a fixed amount of fluid.

The fields are specifically as follows:

(A) Providing beverage out of a store.

Providing post-mix beverage described in the embodiment, providing pre-mix beverage, and providing tea and hot water.

(B) In a store, providing a fixed amount of beverage and alcoholic liquors, and providing a fixed amount of the fluid such as seasonings and seasoning liquors.

In a store, providing post-mix beverage and pre-mix beverage, pouring seasonings such as ketchup, mayonnaise, and sauce, and pouring soup and sauce for noodles.

(C) Providing a fixed amount of the fluid such as seasonings and seasoning liquors in a field of the food industry.

Pouring seasonings into food and pouring soup and sauce for noodles in the food manufacturing.

(D) Providing fluid in gardening and agricultural fields.

Spraying water, fertilizer, and agricultural chemicals on growing crops and feeding water, feeds, and drugs to livestock.

(E) Providing fluid in industrial fields.

Providing oil and water to machines, pouring lubricating oils and grease into machines and tools, for example.

(F) Providing fluid in households.

Providing water to gardening plants and feeding water and feeds to pet animals:

(G) Providing fluid in other categories and fields.

Of course, the present invention can be applied to a device for supplying a fixed amount of fluid in any of categories and fields other than those described above.

A system for supplying a fixed amount of fluid according to the present invention is not limited to the beverage supplying systems described above in such a manner; various modifications can be made within the spirit and scope of the present invention.

What is claimed is:

1. A system for supplying a fixed amount of fluid comprising:

a fluid accommodating unit comprising a fluid accommodating bag for accommodating fluid therein and a bellows pump connected to the fluid accommodating bag for pumping the fluid; and a fluid supplying device in which the pump driving mechanism for driving the bellows pump is disposed detachably to the fluid accommodating unit, the system supplying a fixed amount of the fluid by the fluid accommodating unit in the fluid supplying device when the fluid is being supplied, wherein the bellows pump connected to the fluid accommodating bag comprises a bellows and two check valves arranged in a fluid inlet and a fluid outlet of the bellows, respectively, wherein the check valves of the bellows pump are each comprising a valve base whose downstream surface is curved to be convex toward the downstream side and a valve body made from an elastic thin plate for covering the downstream surface of the valve base, wherein the valve base having more than one fluid-flow-through holes piercing from the fluid upstream surface all the way to the downstream surface, wherein the valve body is fixed to the valve base on its periphery and has a hole at its center for allowing the flow of the fluid, wherein the pump-driving mechanism of the fluid supplying device is adapted to drive the bellows so as to expand and contract the bellows at a predetermined stroke when the fluid accommodating unit is placed in the system for supplying a fixed amount of fluid, wherein an outlet of the bellows pump is provided with a sealing-valve mechanism for closing the outlet, and the fluid supplying device is provided with a sealing-valve driving device for driving the sealing-valve mechanism when the bellows pump is not being driven, wherein the afore mentioned sealing-valve mechanism comprises a cylinder which vertically moves so that the periphery of the valve body hole of the check valve arranged at the downstream surface can be pushed against the valve base while allowing the fluid to flow-through the inside of the cylinder.

2. A system according to claim 1, wherein an end of the fluid accommodating bag is provided with a replacement part fitting that can attach a replacement part to the fluid accommodating bag, and wherein the replacement part is a mixing device for mixing a fixed amount of the fluid supplied with another kind of fluid.

3. A system according to claim 1, wherein the valve body is a thin film in which the thickness decreases toward the hole formed at the center.

4. A system according to claim 1, wherein the valve body is a thin film in which the thickness decreases toward the hole formed at the center.

5. A system according to claim 1, wherein the pump-driving mechanism is a reciprocating mechanism for the expanding and contracting movement of the bellows by the check valve arranged at the fluid inlet or the check valve arranged at the fluid outlet.

6. A system according to claim 5 characterized by, with the expansion and contraction of the bellows (21) driven by the aforementioned pump-driving mechanism (50), emitting the accommodated fluid into the bellows (21) through the check valve **(30*u*) with the expanding movement of compressing the valve body (35) of the check valve (30*d*) arranged at the downstream surface against the valve base (31) and pulling apart the valve body (35) of the check valve (30*u*) arranged at the upstream surface from the valve base (31) at the same time, and also emitting the fixed amount of accommodated fluid through the check valve (30*d*) arranged at the downstream surface with the contracting movement of compressing the valve body (35) of the check valve (30*u*) arranged at the upstream surface against the valve base (31), and pulling apart the valve body (35) of the check valve (30*d*) arranged at the downstream surface from the valve base (31)** at the same time.

7. A bellows pump device comprising;

a bellows (21) in the form of bellow and two check valves **(30*u*, 30*d*) arranged at the fluid-inlet and fluid-outlet at each ends of the bellows (21); and wherein the afore mentioned check valves (30*u*, 30*d*) comprising a valve base (31) in a form of arch with its downstream surface curved to be convex to the downstream while its upstream surface configured with a recess, and a valve body (35) formed of an elastic thin plate which can be expanded and contracted freely and covering the downstream surface of the valve base (31), wherein the afore mentioned valve base (31) comprising more than one fluid-flow-through holes (34, 34) piercing from the fluid upstream surface all the way to the downstream surface, wherein the above mentioned valve body (35) having a hole (36) at the center thereof for allowing the flow of the fluid while being fixed to the valve base (31) on its periphery, which enable to open and close the fluid-flow-through holes (34, 34) of the valve base (31) freely, and which is characterized by delivering a fixed amount of accommodated fluid from the check valve (30*d*) arranged at the downstream by expanding and contracting the bellows (21) at a predetermined stroke so as to compress one end of the valve body (35) against the valve base (31) while pulling apart the other end of the valve body (35) from the valve base (31)**.

8. A device according to claim 7, characterized by having cylinders (22) attached to the fluid-inlet and fluid-outlet of the afore mentioned bellows (21), respectively, and within these cylinders (22), the aforementioned check valve **(30*u*, 30*d*)** is arranged.

9. A device according to claim 8, characterized by the aforementioned valve base (31) formed in a round shape, and flange (33) formed in the periphery thereof, while aforementioned valve body (35) fixed closely adjacent to the aforementioned valve base (31) with its periphery clamped by the afore mentioned flange (33).

10. A device according to claim 9, characterized by more than one fluid-flow-through holes (34, 34) on the aforementioned valve base (31) arranged in parallel with the axis of the of the valve base (31), and spaced equally on the concentric circle, which is situated on the aforementioned axis.

11. A device according to claim 10 characterized by the aforementioned valve body (35) formed from an elastic material such as silicone rubber to have a circular disc shape in a form of thin film, and a round hole (36) is penetrated at the center thereof.

12. A device according to claim 11 characterized by, with the expansion and contraction movement of the bellows (21), emitting the accommodated fluid into the bellows (21) through the check valve **(30*u*) with the expanding movement of compressing the valve body (35) of the check valve (30*d*) arranged at the downstream surface against the valve base (31) and pulling apart the valve body (35) of the check valve (30*u*) arranged at the upstream surface from the valve base (31) at the same time, and also emitting the fixed amount of accommodated fluid through the check valve (30*d*) arranged at the downstream surface with the contracting movement of compressing the valve body (35) of the check valve (30*u*) arranged at the upstream surface against the valve base (31), and pulling apart the valve body (35) of the check valve (30*d*) arranged at the downstream surface from the valve base (31)** at the same time.

* * * * *